US006356870B1

(12) United States Patent
Hui et al.

(10) Patent No.: US 6,356,870 B1
(45) Date of Patent: Mar. 12, 2002

(54) METHOD AND APPARATUS FOR DECODING MULTI-CHANNEL AUDIO DATA

(75) Inventors: Yau Wai Lucas Hui; Sapna George, both of Singapore (SG)

(73) Assignee: STMicroelectronics Asia Pacific PTE Limited, Singapore (SG)

( * ) Notice: Subject to any disclaimer, the term of this patent is extended or adjusted under 35 U.S.C. 154(b) by 0 days.

(21) Appl. No.: 09/297,395

(22) PCT Filed: Sep. 26, 1997

(86) PCT No.: PCT/SG97/00045

§ 371 Date: Aug. 19, 1999

§ 102(e) Date: Aug. 19, 1999

(87) PCT Pub. No.: WO98/19407

PCT Pub. Date: May 7, 1998

(30) Foreign Application Priority Data

Oct. 31, 1996 (SG) ..... 9610976

(51) Int. Cl.[7] ..... G10L 19/00

(52) U.S. Cl. ..... 704/500; 704/503

(58) Field of Search ..... 704/500, 219, 704/228, 230, 501, 502, 503, 504, 200, 201, 200.1, 216, 217, 218, 224, 225, 229; 381/80, 300, 307

(56) References Cited

U.S. PATENT DOCUMENTS 5,845,249 A * 12/1998 Malladi et al. ..... 704/270
5,960,401 A * 9/1999 Ran et al. ..... 704/500
6,009,389 A * 12/1999 Dokic et al. ..... 704/228
6,012,142 A * 1/2000 Dokic et al. ..... 713/2
6,098,044 A * 8/2000 Huang ..... 704/500
6,122,619 A * 9/2000 Kolluru et al. ..... 704/500
6,128,597 A * 10/2000 Kolluru et al. ..... 704/500
6,145,007 A * 11/2000 Dokic et al. ..... 709/230
6,205,430 B1 * 3/2001 Hui ..... 704/500

OTHER PUBLICATIONS

Davidson, G. et al., "A Low–Cost Adaptive Transform Decoder Implementation for High–Quality Audio", *Speech Processing 2, Audio, Neural Networks, Underwater Acoustics,* San Francisco, Mar. 23–26, 1992, vol. 2, Conf., 17, Mar. 23, 1992, Institute of Electrical and Electronics Engineers, pp. 193–196, XP000356970.

Vernon, Steve, "Design and Implementation of AC–3 Coders", IEEE Transactions on Consumer Electronics, vol. 41, No. 3, Aug. 1995, New York, US, pp. 754–759, XP000539533.

Bosi, M., and Forshay, S.E., "High Quality Audio Coding for HDTV: An Overview of AC–3", Signal Processing of HDTV, VI; Proceedings of the International Workshop on HDTV '94, Oct. 26–28, 1994, Turin, IT, pp. 231–238, XP002067767.

* cited by examiner

*Primary Examiner*—Richemond Dorvil
(74) *Attorney, Agent, or Firm*—Liba Johnson; Robert Iannucci; Seed Ip Law Group, PLLC

(57) ABSTRACT

A method and apparatus for decoding a bitstream (100) of transform coded multi-channel audio data. The bitstream is subjected to a block decoding process (101) to obtain for each input audio channel within the multi-channel audio data a corresponding block of frequency coefficients (102). Each block of frequency coefficients (102) is assigned a higher precision inverse transform or a lower precision inverse transform according to predetermined characteristics of the audio data represented by the block. The blocks of frequency coefficients are subsequently subjected to the assigned transform (105, 106) and an output audio signal (108) is generated in response to each of the higher and lower precision inverse transform processes.

18 Claims, 2 Drawing Sheets

METHOD AND APPARATUS FOR DECODING MULTI-CHANNEL AUDIO DATA

CROSS-REFERENCE TO RELATED APPLICATIONS

This application claims the benefit of International Application No. PCT/SG97/00045 filed Sep. 26, 1997.

STATEMENT REGARDING FEDERALLY SPONSORED RESEARCH OR DEVELOPMENT

Not Applicable

BACKGROUND OF THE INVENTION

1. Field of the Invention

This invention relates to multi-channel digital audio decoders for digital storage media and transmission media.

2. Description of the Related Art

As efficient multi-channel digital audio signal coding methods have been developed for storage or transmission applications such as the digital video disc (DVD) player and the high definition digital TV receiver (set-top-box). A description of one such method can be found in the ATSC Standard, "Digital Sudio Compression (AC-3) Standard", Document A/52, 20 Dec. 1995. The standard defines a coding method for up to six channels of multi-channel audio, that is, left, right, centre, surround left, surround right, and the low frequency effects (LFE) channel. Techniques of this type can be applied in general to code any number of channels of related or even unrelated audio data into single or multiple representations (bitstreams).

In the ATSC(AC-3) method, the input multi-channel digital audio source is compressed block by block at the encoder by first transforming each block of time domain audio samples into frequency coefficients using an analysis filter bank, then quantizing the resulting frequency coefficients into quantized coefficients with a determined bit allocation strategy, and finally formatting and packing the quanitzed coefficients and bit allocation information into a bitstream for storage or transmission.

Furthermore, depending upon the spectral and temporal characteristics of each channel in the audio source, the transformation of each audio channel block may be performed adaptively at the encoder to optimize the frequency/time resolution. This is achieved by adaptive switching between two transformations with long transform block length or shorter transform block length. The long transform block length which has good frequency resolution is used for improved coding performance, and the shorter transform block length which has greater time resolution is used for audio input signals which change rapidly in time.

At the decoder, each audio block is decompressed from the bitstreams by first determining the bit allocation information, then unpacking and de-quantizing the quantized coefficients, and inverse transforming the resulting frequency coefficients based on determined long or shorter transform length to output time domain audio PCM data. The decoding processes are performed for each channel in the multi-channel audio data.

For reasons such as an overall system cost constraint or physical limitation such as the number of output loudspeakers that can be used, downmixing of the decoded multi-channel audio may be performed so that the number of output channels at the decoder is reduced. Basically, downmixing is performed such that the multi-channel audio information is fully or partially preserved while the number of output channel is reduced. For example, multi-channel coded audio bitstreams may be decoded and mixed down to two output channels, the left and right channel, suitable for conventional stereo audio amplifier and loudspeakers systems. One method of downmixing may be described as:

$$A_i = \sum_{j=0}^{m} (a_{ij} \times CH_j)$$

where i: the selected output audio channel number j: input audio channel number m: the total number of input audio channels $A_i$: i-th output audio channel $CH_j$: j-th input audio channel $a_{ij}$: downmixing coefficient for the i-th output and j-th input audio channel The downmixing method or coefficients may be designed such that the original or the approximate of the original decoded multi-channel signals may be derived from the mixed down channels.

The complexity or cost of decoding for such current art multi-channel audio decoder is more or less proportional to the number of coded audio channels within the input bitstream. In particular, the inverse transform process, which is computationally the most intensive module of the audio decoder and incurs a much higher cost to implement compared to other processes within the audio decoder, is performed on every block of audio in every audio channel. For example, a six channel audio decoder would have about three times the complexity or cost of decoding compared to a stereo (two channel) audio decoder with the same decoding process for each audio channel.

BRIEF SUMMARY OF THE INVENTION

It is an object of this invention to provide a method and apparatus for decoding a bitstream of transform coded multi-channel audio data which will overcome or at least ameliorate, the foregoing disadvantages of the prior art.

One factor that affects the complexity or implementation cost of the mentioned inverse transform is the arithmetic precision used within the process. The precision adopted in this module has a direct relation to the cost (in terms of the amount of RAM/ROM required) and complexity in implementation. Also, the inverse transform is the most demanding stage in terms of introduction of round off noise. Generally, the higher the precision used within the inverse transform process, the higher the implementation cost and the output quality; and vice versa, the lower the precision used within the inverse transform process, the lower the implementation cost and the output quality.

Arithmetic precision considerations in the Inverse Transform involve the word size of the frequency coefficients and the twiddle factors used in each stage, as well as the intermediate data retained between stages. The frequency coefficients generated by the data decoding stage are retained to the degree of accuracy defined by the precision required.

On the other hand, the audio channels represented within the multi-channel audio bitstream may have different perceptual importance relative to the actual audio contents. For examples, a surround effect channel may have relatively less perceptual importance compared to a main channel, or an audio block with shorter transform block length which has audio signals that change rapidly in time may have less frequency resolution requirement compared to an audio block with long transform block length.

By matching different precision for the inverse transform process within the multi-channel audio decoder with the audio contents within the coded multi-channel audio bitstream, the overall complexity or implementation cost of the decoder can be optimized.

According to a first aspect, this invention provides a method for decoding a bitstream of transform coded multi-channel audio data comprising the steps of:

(a) subjecting said bitstream to a block decoding process to obtain for each input audio channel within said multi-channel audio data a corresponding block of frequency coefficients;

(b) assigning to each said block of frequency coefficients a higher precision inverse transform or a lower precision inverse transform according to predetermined characteristics of said audio data represented by the block;

(c) subjecting each said block of frequency coefficients to higher precision inverse transform process of lower precision inverse transform process;

(d) generating a respective output audio signal in response to each said higher precision inverse transform process and each said lower precision inverse transform process.

In a second aspect, this invention provides an apparatus for decoding a bitstream of transform coded multi-channel audio data comprising:

(a) block decoding means to produce for each input audio channel within the said multi-channel audio data a corresponding block of frequency coefficients;

(b) means for assigning to each said block of frequency coefficients a higher precision inverse transform or a lower precision inverse transform according to predetermined characteristics of said audio data represented by the block;

(c) means for subjecting each said block of frequency coefficients according to said assigned higher precision inverse transform process or lower precision inverse transform process;

(d) means for generating a respective output audio signal in response to each said higher precision inverse transform process and lower precision inverse transform process.

Preferably, the blocks of frequency of all the input audio channels are downmixed in the frequency domain to a reduced number of intermediate blocks of frequency coefficients; and each intermediate block of frequency coefficient is assigned a higher precision inverse transform or a lower precision inverse transform according to predetermined characteristics of the audio data represented by the block.

Alternately, the blocks of frequency coefficients of all input audio channels coded adaptively with long or shorter transform block length can be downmixed partially in the frequency domain to a reduced number of intermediate blocks of frequency coefficients; and assigned a higher precision inverse transform or a lower precision inverse transform according to predetermined characteristics of the audio data represented by the block.

The block decoding preferably involves:

(a) parsing said bitstream to obtain bit allocation information of each input audio channel;

(b) unpacking quantized frequency coefficients from said bitstream using said bit allocation information;

(c) de-quantizing said quantized frequency coefficients to obtain said block of frequency coefficients using said bit allocation information.

Preferably, the higher precision inverse transform process applies a frequency-domain to time-domain transform to the respective block of frequency coefficients using higher precision arithmetic parameters and operations, and the lower precision inverse transform process applies a frequency-domain to time-domain transform to the respective block of frequency coefficients using lower precision arithmetic parameters and operations.

In an alternative, the higher precision inverse transform process applies subband synthesis filter bank to the respective block of frequency coefficients using higher precision arithmetic parameters and operations, and the lower precision inverse transform process applies subband synthesis filter bank to the respective block of frequency coefficients using lower precision arithmetic parameters and operations.

Preferably, the higher precision inverse transform uses a digital signal processor with double precision wordlength and the lower precision inverse transform uses the same digital signal processor with single precision wordlength. The digital signal processor is preferably a 16-bit processor.

In an embodiment of the present invention, the de-quantized frequency coefficients of each coded audio channel within a block, obtained by deformatting the input multi-channel audio bitstream, are subjected to selection means whereby the higher or lower precision inverse transform are determined for inverse transforming the de-quantized frequency coefficients of each coded audio channel within the block such that the decoding complexity is reduced without introducing significant artefacts in overall output audio quality.

Preferably, de-quantized coefficients of all coded audio channels can be mixed down in frequency domain such that the total number of inverse transform is reduced to the number of output audio channel required. The de-quantized frequency coefficients of the audio channel blocks which were coded adaptively with long or shorter transform block length can preferably be mixed down partially in the frequency domain according to the long and shorter transform block length needs so that the total number of inverse transform, higher and lower precision, is reduced to an intermediate number, and the final output audio channels are generated by combining the results of the inverse transform in time domain.

The means for assigning higher or lower precision inverse transform processes is preferably implemented in such a way that the decoding complexity is maintained while the output audio quality is improved. Parameters which may be used include number of coded audio channels, audio content information, long or shorter transform block switching information, output channel information, complexity required, and/or output audio quality required.

It will be apparent that with the addition of a relatively simple selector for higher or lower precision inverse transform, the overall complexity or implementation cost of the multi-channel audio decoder is reduced or optimized. An intelligent selector may be designed for multi-channel audio applications in such a way that perceptual importance of each audio channel is used to determine the precision of the inverse transform process, and maintains the overall subjective quality of the output audio channels. Simplification of the precision requirements for the inverse transform process for certain audio channels significantly benefits low cost multi-channel audio decoder implementations and applications.

Two embodiments of the invention will now be described, by way of example only, with reference to the accompanying drawings.

DETAILED DESCRIPTION OF THE INVENTION

Figure 1:
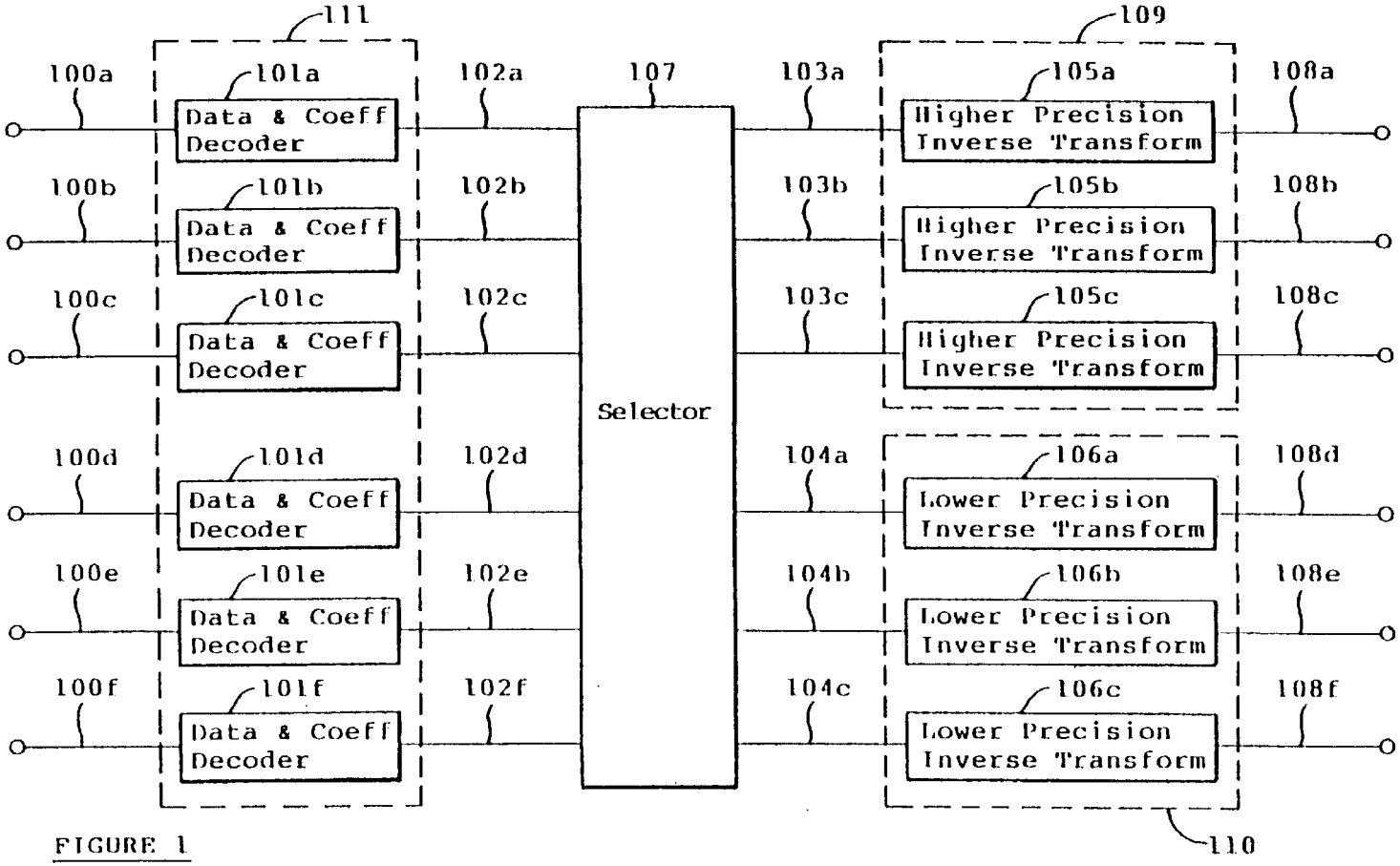
FIG. 1 is a functional block diagram illustrating the basic structure of a first embodiment of the invention for the case of six coded audio channel.

FIG. 1 illustrates one embodiment of multi-channel audio decoder according to the present invention which decodes six input audio channels with three higher precision inverse transform and three lower precision inverse transform. The choice of ratio of the number of higher preceiosn inverse transform and the number of lower precision inverse transform is basically determined by the decoder complexity and audio quality required. The multi-channel audio decoder receives transform coded bitstream 100 of the six channel audio, decodes the bitstream by data and coefficient decoder 101, one for each input audio channel. The selector 107 receives results of the data and coefficient decoder 101 from path 102, determines for each input audio channel the choice of higher precision inverse transform or lower precision inverse transform. Input audio channels which are selected for higher precision inverse transform are subjected to higher precision inverse transform 105 via path 103. Similarly, input audio channels which are selected for lower precision inverse transform are subjected to lower precision inverse transform 106 via path 104. Outputs from the higher and lower precision inverse transform are transmitted to the correct audio presentation channel for any post processing or audio/sound reproduction via path 108.

An example of the transform bitstream is the AC-3 bitstream according to the ATSC Standard, "Digital Audio Compression (AC-3) Standard", Document A/52, Dec. 20, 1995. The AC-3 bitstream consists of coded information of up to six channels of audio signal including the left channel (L), the right channel (R), the centre channel (C), the left surround channel (LS), the right surround channel (RS), and the low frequency effects channel (LFE). However, the maximum number of coded audio channels for the input is not limited. The coded information within the AC-3 bitstream is divided into frames of 6 audio blocks, and each audio block contains the information for all of the coded audio channel block (ie: L, R, C, LS, RS and LFE). The corresponding data and coefficient decoder 101 for AC-3 bitstream consists of steps of parsing and decoding the input bitstream to obtain the bit allocation information for each audio channel block, unpacking and de-quantizing the quantized frequency coefficients of each audio channel block from the bitstream using the bit allocation information. Further details on implementation of the data and coefficient decoder for input AC-3 bitstream can be found in the ATSC (AC-3) standard specification.

The selector 107 in the embodiment illustrated in FIG. 1 according to the present invention, consists of means of determine the choice of higher or lower precision inverse transform by the audio channel assignment information of the input. For example, the input channels containing the L, R and C channel information are transmitted to the higher precision inverse transform 105, and the input channels containing the LS, RS, and LFE channel information are transmitted to the lower precision inverse transform 106. Another means of determining the choice of higher or lower precision inverse transform in the case of AC-3 or similar application bitstream is by the combination of audio channel assignment information and long or shorter transform block length information. In this example, the audio channel blocks with long transform block length information will have higher priority for higher precision inverse transform. Yet another means of determining the choice of higher or lower precision inverse transform is by giving higher priority for inputs that contain important audio information content to higher precision inverse transform.

An inverse transform according to the present invention refers to a conventional frequency to time domain transform or synthesis filter bank. One example of such transform uses the Time Domain Aliasing Cancellation (TDAC) technique according to the ATSC (AC-3) standard specification. The implementation of higher or lower precision inverse transform is determined by the precision or wordlength of various parameters, such as the transform coefficients and the filtering coefficients, and arithmetic operations used in the inverse transform. The use of longer wordlength improves dynamic range or audio quality but increases cost, as the wordlength of both the arithmetic units and the working memory RAM must be increased. In one example, a higher precision inverse transform may be implemented using a conventional 16-bit fixed point DSP (Digital Signal Processor) with double precision wordlength (32-bit) for transform coefficients, intermediate and output data, and single precision wordlength (16-bit) for filtering coefficients, while the lower precision inverse transform is implemented using the same DSP with only single precision (16-bit) for all parameters in the transform computation.

Figure 2:
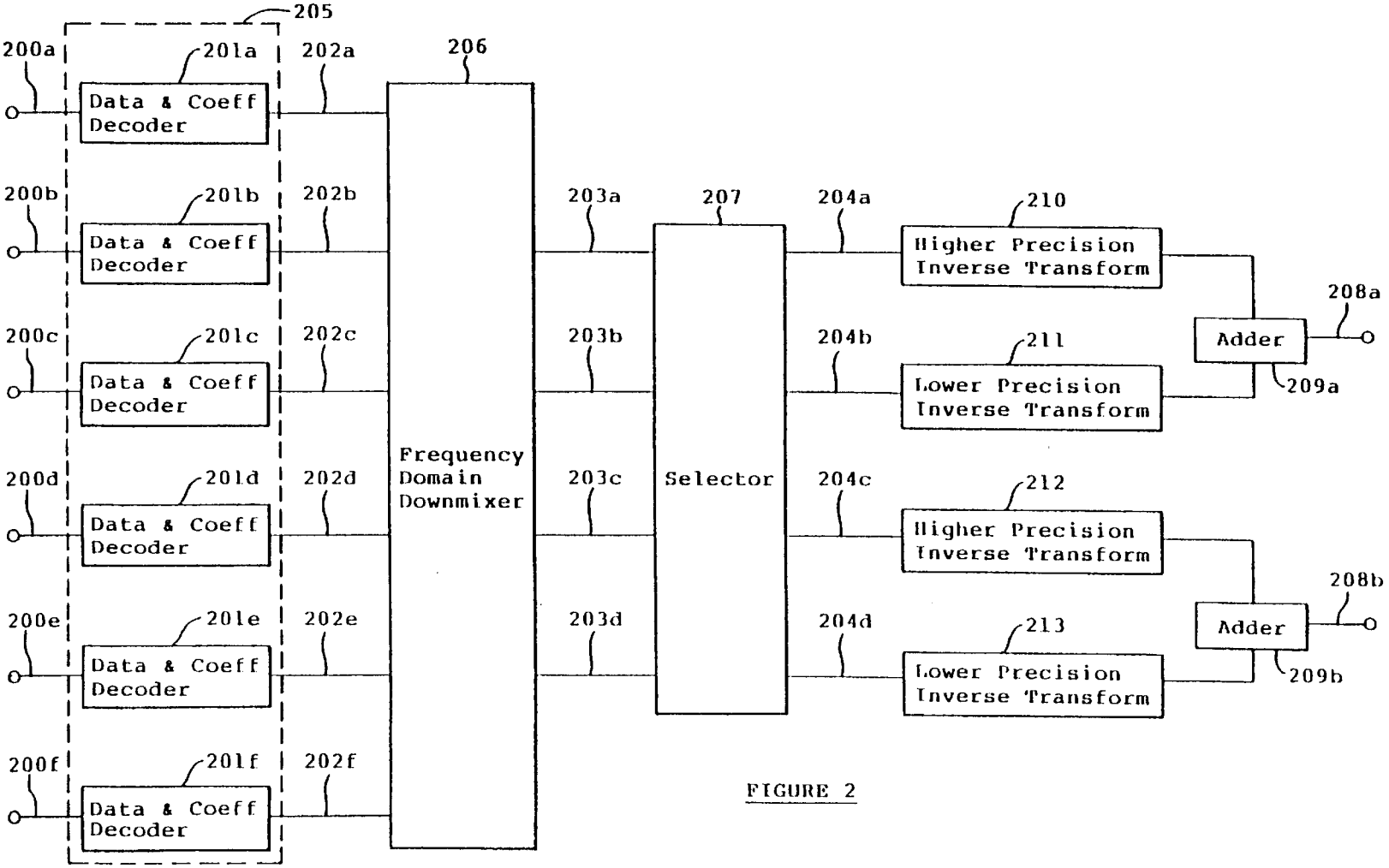
FIG. 2 is a functional block diagram illustrating the basic structure of a second embodiment of the invention with partial frequency and time domain downmixing for the case of six input coded audio channel and two output mixed down channels.

The present invention can be applied to decoder implementations where downmixing is performed in the frequency domain. It can also be applied to decoders with inverse transform that supports switching of long and shorter transform block length. FIG. 2 illustrates another embodiment of the presenting invention where partial frequency and time domain downmixing are performed such that the number of output audio channels is mixed down from six input audio channels to two, and the inverse transform supports switching of long and shorter transform block length. The multi-channel audio decoder receives transform coded bitstream 200, decodes the bitstream by data and coefficient decoder 201, and produces the frequency coefficients of each coded audio channel block on data path 202.

At the frequency domain downmixer 206, the inputs are mixed down according to the associated downmixing coefficients and long and shorter transform block length information of each audio channel block. Frequency coefficients for first output channel (C1) are mixed down and outputted separately for long transform block length coefficients on path 203*a*($C1_{ML}$) and shorter transform block length coefficients on path 203*b* ($C1_{MS}$); similarly, the frequency coefficients for second output channel (C2) are mixed down and outputted separately for long transform block length coefficients on path 203*c*($C2_{ML}$) and shorter transform block length coefficients on path 203*d*($C2_{MS}$). Example equations that may describe the implementation of the frequency domain downmixer for two output channel are given as follow:

$$C1_{ML} = \sum_{i=0}^{n} (a_i \times CH_i \times LS_i)$$

$$C1_{MS} = \sum_{i=0}^{n} (a_i CH_i \times \overline{LS_i})$$

$$C2_{ML} = \sum_{i=0}^{n} (b_i \times CH_i \times LS_i)$$

$$C2_{MS} = \sum_{i=0}^{n} (b_i \times CH_i \times \overline{LS_i})$$

where $LS_i$ is the "Boolean" (0=shorter, 1=long) representation of the long and shorter transform block length switch for each of the input i=0 to n $a_i$ is the downmixing coefficient for first output channel and i-th input channel $b_i$ is the downmixing coefficient for second output channel and i-th input channel $CH_i$ is the frequency coefficient of the i-th input audio channel block $C1_{ML}$ is mixed down coefficient of long transform block of first output channel $C1_{MS}$ is mixed down coefficient of shorter transform block of first output channel $C2_{ML}$ is mixed down coefficient of long transform block of second output channel $C2_{MS}$ is mixed down coefficient of shorter transform block of second output channel The partially mixed down frequency coefficients on path 203 are input to the selector 207 where the choice of higher or lower precision inverse transform is decided for mixed down frequency coefficients of long and shorter transform block of each output channel. An example implementation of the selector 207 subjects the mixed down frequency coefficients of long transform block of first output channel ($C1_{ML}$) to higher precision inverse transform 210, the mixed down frequency coefficients of shorter transform block of first output channel ($C1_{MS}$) to lower precision inverse transform 211, the mixed down frequency coefficients of long transform block of second output channel ($C2_{ML}$) to higher precision inverse transform 212, and the mixed down frequency coefficients of shorter transform block of second output channel ($C2_{MS}$) to lower precision inverse transform 213. Another possible implementation of the selector 207 may consist means of identifying which of the inputs $C1_{ML}$ or $C1_{MS}$ that contains main audio content information, and subjecting corresponding input with higher audio content information importance to higher precision inverse transform and input with lower audio content information importance to lower precision inverse transform. Similarly, the selection of $C2_{ML}$ to $C2_{MS}$ for higher or lower precision inverse transform is done.

The implementations of the higher precision inverse transform (numeral 210 and 212 of FIG. 2) and lower precision inverse transform (numeral 211 and 213 of FIG. 2) are similar to those described above. In addition, the inverse transforms support switching between long transform (for $C1_{ML}$ and $C2_{ML}$) are shorter transform (for $C1_{MS}$ and $C2_{MS}$) block length such as those described in the ATSC (AC-3) specifications. After the inverse transform, the output of higher precision inverse transform and lower precision inverse transform are combined in time domain by adder 209 to form the first and second output audio channel 208 (C1 and C2).

The foregoing describes only two embodiments of this invention and modifications can be made without departing from the scope of the invention.

What is claimed is:

1. A method of decoding a bitstream of transform coded multi-channel audio data comprising the steps of:

(a) subjecting said bitstream to a block decoding process to obtain for each input audio channel within said multi-channel audio data a corresponding block of frequency coefficients;

(b) assigning to each said block of frequency coefficients a higher precision inverse transform or a lower precision inverse transform according to predetermined characteristics of said audio data represented by the block;

(c) subjecting each said block of frequency coefficients to higher precision inverse transform process or lower precision inverse transform process;

(d) generating a respective output audio signal in response to each said higher precision inverse transform process and each lower precision inverse transform process.

2. A method of decoding a bitstream of transform coded multi-channel audio data comprising the steps of:

(a) subjecting said bitstream to a block decoding process to obtain for each input audio channel within the said multi-channel audio data a corresponding block of frequency coefficients;

(b) downmixing in the frequency domain said blocks of frequency coefficients of all said input audio channels to a reduced number of intermediate blocks of frequency coefficients;

(c) assigning to each said intermediate block of frequency coefficients a higher precision inverse transform or a lower precision inverse transform according to predetermined characteristics of said audio data represented by the block;

(d) subjecting each said intermediate block of frequency coefficients to said assigned higher precision inverse transform process or lower precision inverse transform process;

(e) generating a respective output audio signal in response to each said higher precision inverse transform process and each said lower precision inverse transform process.

3. A method of decoding a bitstream of transform coded multi-channel audio data comprising the steps of:

(a) subjecting said bitstream to a block decoding process to obtain for each input audio channel within the said multi-channel audio data a corresponding block of frequency coefficients;

(b) downmixing partially in the frequency domain said blocks of frequency coefficients of all said input audio channels to a reduced number of intermediate blocks of frequency coefficients;

(c) assigning each said intermediate block of frequency coefficients a higher precision inverse transform or a lower precision inverse transform according to predetermined characteristics of said audio data represented by the block;

(d) subjecting each said intermediate block of frequency coefficients to said assigned higher precision inverse transform process or lower precision inverse transform process;

(e) combining in time domain the results of the said higher precision inverse transform process and said lower precision inverse transform process to form a further reduced number of blocks of time domain audio samples; and (f) generating a respective output audio signal in response to each said block of time domain audio samples.

4. A method according to any one of claims 1 to 3, wherein said block decoding process comprises the step of:

(a) parsing said bitstream to obtain bit allocation information of each input audio channel;

(b) unpacking quantized frequency coefficients from said bitstream using said bit allocation information;

(c) de-quantizing said quantized frequency coefficients to obtain said block of frequency coefficients using said bit allocation information.

5. A method according to any one of claims 1 to 3, wherein said higher precision inverse transform process applies a frequency-domain to time-domain transform to the respective said block of frequency coefficients using higher precision arithmetic parameters and operations, and said lower precision inverse transform process applies a frequency-domain to time-domain transform to the respective said block of frequency coefficients using lower precision arithmetic parameters and operations.

6. A method according to any one of claims 1 to 3, wherein said higher precision inverse transform process applies subband synthesis filter bank to the respective said block of frequency coefficients using higher precision arithmetic parameters and operations, and said lower precision inverse transform process applies subband synthesis filter bank to the respective said block of frequency coefficients using lower precision arithmetic parameters and operations.

7. A method according to any one of claims 1 to 3, wherein said higher precision inverse transform uses a digital signal processor with double precision wordlength and said lower precision inverse transform uses the same digital signal processor with single precision wordlength.

8. A method as claimed in claim 7, wherein said digital signal processor is a 16-bit processor.

9. A method as claimed in any one of claims 1 to 3, wherein said predetermined characteristics of said audio data include one or more of the number of coded audio channels, audio content information, long or shorter transform block switching information and output channel information.

10. An apparatus for decoding a bitstream of transform coded multi-channel audio data comprising:

(a) block decoding means to produce for each input audio channel within the said multi-channel audio data a corresponding block of frequency coefficients;

(b) means for assigning to each said block of frequency coefficients a higher precision inverse transform or a lower precision inverse transform according to predetermined characteristics of said audio data represented by the block;

(c) means for subjecting each said block of frequency coefficients according to said assigned higher precision inverse transform process or lower precision inverse transform process;

(d) means for generating a respective output audio signal in response to each said higher precision inverse transform process and lower precision inverse transform process.

11. An apparatus for decoding a bitstream of transform coded multi-channel audio data comprising:

(a) block decoding means to produce for each input audio channel within the said multi-channel audio data a corresponding block of frequency coefficients;

(b) means for downmixing in the frequency domain said blocks of frequency coefficients of all said input audio channels to a reduced number of intermediate blocks of frequency coefficients;

(c) means for assigning to each said intermediate block of frequency coefficients a higher precision inverse transform or a lower precision inverse transform according to predetermined characteristics of said audio data;

(d) means for subjecting each said intermediate block of frequency coefficients to said assigned higher precision inverse transform process or lower precision inverse transform process;

(e) means for generating a respective output audio signal in response to each said higher precision inverse transform process and lower precision inverse transform process.

12. An apparatus for decoding a bitstream of transform coded multi-channel audio data comprising:

(a) block decoding means to produce for each input audio channel within the said multi-channel audio data a corresponding block of frequency coefficients;

(b) means for downmixing partially in the frequency domain said blocks of frequency coefficients of all said input audio channels to a reduced number of intermediate blocks of frequency coefficients;

(c) means for assigning to each said intermediate block of frequency coefficients a higher precision inverse transform or a lower precision inverse transform according to predetermined characteristics of said audio data;

(d) means for subjecting each said intermediate block of frequency coefficients according to the determined choice to higher precision inverse transform process or lower precision inverse transform process;

(e) means for combining in the time domain the results of the said higher precision inverse transform process and lower precision inverse transform process to form a further reduced number of blocks of rime domain audio samples;

(f) means for generating a respective output audio signal in response to each said block of time domain audio samples.

13. An apparatus according to any one of claims 10 to 12, wherein said block decoding means comprises:

(a) means of parsing the said bitstream to obtain bit allocation information of each said input audio channel;

(b) means for unpacking quantized frequency coefficients from said bitstream using said bit allocation information; and (c) means for de-quantizing said quantized frequency coefficients to obtain said block of frequency coefficients using said bit allocation information.

14. An apparatus according to any one of claims 10 to 12, wherein said higher precision inverse transform process comprises means for applying a frequency-domain to time-domain transform to the respective said block of frequency coefficients using higher precision arithmetic parameters and operations, and said lower precision inverse transform process comprises means for applying a frequency-domain to time-domain transform to the respective said block of frequency coefficients using lower precision arithmetic parameters and operations.

15. An apparatus according to any one of claims 10 to 12, wherein said higher precision inverse transform process comprises means for applying subband synthesis filter bank to the respective said block of frequency coefficients using higher precision arithmetic parameters and operations, and said lower precision inverse transform process comprises means for applying subband synthesis filter bank to the respective said block of frequency coefficients using lower precision arithmetic parameters and operations.

16. An apparatus according to any one of claims 10 to 12, wherein said higher precision inverse transform uses a digital signal processor with double precision wordlength and said lower precision inverse transform uses the same digital signal processor with single precision wordlength.

17. An apparatus as claimed in claim 16, wherein said digital signal processor is a 16-bit processor.

18. An apparatus as claimed in any one of claims 10 to 12, wherein said predetermined characteristics of said audio data include one or more of the number of coded audio channels, audio content information, long or shorter transform block switching information and output channel information.

* * * * *